US007428859B2

(12) United States Patent
Fujita et al.

(10) Patent No.: US 7,428,859 B2
(45) Date of Patent: Sep. 30, 2008

(54) GUILLOTINE CUTTER

(75) Inventors: Kazuhisa Fujita, Shiga (JP); Ko Ouchiyama, Shiga (JP); Eiji Katayama, Shiga (JP)

(73) Assignee: Horizon International Inc., Shiga (JP)

( * ) Notice: Subject to any disclaimer, the term of this patent is extended or adjusted under 35 U.S.C. 154(b) by 424 days.

(21) Appl. No.: 11/298,974

(22) Filed: Dec. 9, 2005

(65) Prior Publication Data

US 2006/0123969 A1 Jun. 15, 2006

(30) Foreign Application Priority Data

Dec. 10, 2004 (JP) ..... 2004-358516

(51) Int. Cl.
*B26D 7/02* (2006.01)

(52) U.S. Cl. ..... 83/456; 83/466; 83/76.8; 83/370; 83/522.13

(58) Field of Classification Search ..... 83/456, 83/459, 466, 468.1, 452, 72, 74, 76.8, 76.7, 83/371, 372, 370, 360, 361, 365, 368, 36, 83/522.13, 613, 624, 628, 630, 635, 694, 83/934

See application file for complete search history.

(56) References Cited

U.S. PATENT DOCUMENTS

| | | | | |
|---|---|---|---|---|
| 3,148,574 A | | 9/1964 | Heigl et al. | |
| 3,182,542 A | * | 5/1965 | Cochran | 83/453 |
| 5,078,559 A | * | 1/1992 | Abe et al. | 409/304 |
| 5,086,681 A | * | 2/1992 | Ruetschle et al. | 83/277 |
| 5,363,729 A | * | 11/1994 | Ogasawara | 83/389 |
| 5,497,686 A | * | 3/1996 | Mohr | 83/282 |
| 5,806,398 A | * | 9/1998 | Emerson et al. | 83/522.21 |
| 5,911,807 A | * | 6/1999 | Brooks et al. | 83/262 |
| 6,895,847 B2 | * | 5/2005 | Muller | 83/618 |
| 2007/0261525 A1 | * | 11/2007 | Yamaguchi et al. | 83/78 |

FOREIGN PATENT DOCUMENTS

| | | | |
|---|---|---|---|
| EP | 0 590 273 A1 | | 8/1993 |
| EP | 1 201 379 A2 | | 5/2002 |
| EP | 1 669 174 A1 | * | 6/2006 |
| JP | 59-097958 | | 6/1984 |
| JP | 06-191180 | | 7/1994 |
| JP | 2006-159385 | * | 6/2006 |

* cited by examiner

*Primary Examiner*—Boyer D. Ashley
*Assistant Examiner*—Omar Flores-Sánchez
(74) *Attorney, Agent, or Firm*—Kirschstein, et al.

(57) ABSTRACT

A lower guillotine cutter blade (2) is mounted to a frame (1). A guillotine cutter-blade holder (3) holds an upper guillotine cutter blade (4) and vertically reciprocates with respect to the lower guillotine cutter blade (2). Rods (6) are vertically slidably mounted to the guillotine cutter-blade holder (3). A pressing plate (5) is secured to the lower ends of the rods (6). Springs (7) are fitted around the rods (6) between the guillotine cutter-blade holder (3) and the pressing plate (5) for downwardly elastically biasing the rods (6) so that the heads (6*a*) of the rods are kept abutted against the guillotine cutter-blade holder (3). In a cutting operation, after the pressing plate (5) is brought into abutment with a batch of paper (20), the guillotine cutter-blade holder (3) is further downwardly moved, thereby causing the lower and upper guillotine cutter blades (2 and 4) to cut the batch of paper (20) and also causing the heads (6*a*) to upwardly protrude from the guillotine cutter-blade holder (3). At this time, a sensor (8) mounted to the guillotine cutter-blade holder (3) detects the distance to the heads (6*a*). A thickness measuring element (27) determines the thickness of the batch of paper (2) on the basis of the detection signal.

6 Claims, 4 Drawing Sheets

I Measurement of a batch of paper is completed
II First batch of paper ?
III Reference value is stored
IV Difference between measured value and reference value falls within permissible range ?
V Occurrence of book binding error is displayed
VI Reference value is updated
New reference value = (previous reference value + measured value) / 2

GUILLOTINE CUTTER

TECHNICAL FIELD

The present invention relates to a guillotine cutter provided with a thickness measuring device for measurement of the thickness of a batch of paper to be cut.

BACKGROUND ART

Some conventional book binding apparatuses are configured to accumulate, in order, predetermined number of paper sheets or quires such as printing paper sheets to form a batch of paper, fold the batch of paper into halves, bind the folded portion to form a book, and trim the fore edge of the book, or the fore, top, and bottom edges.

Such book binding apparatuses include various types of detectors and monitoring devices in order to prevent the occurrence of book binding errors such as page missing which is a dropout of a portion of paper sheets constituting a book and page redundancy which is redundancy of paper sheets.

However, it has been impossible to overcome the problem that defective products including such book binding errors are progressed to subsequent processes due to the detection accuracies of such detectors and monitoring devices and operators' inefficient handling.

In order to overcome the problem, a weight detecting device is arranged at a process subsequent to the final book-binding process for measuring the weights of finished books for detecting page missing or page redundancy therein and separating defective products and non-defective products (Japanese Patent No. 3496438).

However, the aforementioned configuration has required a wide space for installing the weight detecting device, thereby causing the problem of complicacy and high cost of the entire book binding system.

SUMMARY OF THE INVENTION

Therefore, it is an object of the present invention to enable detection of page missing and page redundancy during book binding processes with a simple and low-cost configuration, without providing a weight detecting device.

In order to overcome the aforementioned problem, the present invention provides a guillotine cutter comprising: a frame having an elongated rectangular-shaped flat supporting surface; a lower guillotine cutter blade mounted on the supporting surface of the frame, the lower guillotine cutter blade comprising a blade portion extending along one side of the supporting surface and an elongated flat plate portion connecting with the blade portion, a portion of a batch of paper being placed on the plate portion; a guillotine cutter-blade holder; an upper guillotine cutter blade mounted to the guillotine cutter-blade holder and arranged oppositely to the lower guillotine cutter blade; guide means mounted to the frame for vertically guiding the guillotine cutter-blade holder in such a manner that the guillotine cutter-blade holder is movable at least between a cutting position at which the upper guillotine cutter blade engages with the lower guillotine cutter blade and a standby position at which the upper guillotine cutter blade is upwardly spaced apart from the lower guillotine cutter blade; driving means for reciprocally moving the guillotine cutter-blade holder in the vertical direction; at least one rod mounted to the guillotine cutter-blade holder at a position corresponding to the plate portion of the lower guillotine cutter blade for vertical slide movement; a pressing plate arranged oppositely to the plate portion of the lower guillotine cutter blade and secured to the lower end of the rod which is downwardly protruded from the guillotine cutter-blade holder; a flat head provided at the upper end of the rod which is upwardly protruded from the guillotine cutter-blade holder; and a spring fitted around the rod between the guillotine cutter-blade holder and the pressing plate for downwardly elastically biasing the rod to keep the head abutted against the guillotine cutter-blade holder, during downward movement of the guillotine cutter-blade holder from the standby position toward the cutting position, the pressing plate being brought into abutment with the batch of paper placed on the plate portion of the lower guillotine cutter blade, thereafter, the guillotine cutter-blade holder being further downwardly moved, so that the batch of paper is cut by the lower and upper guillotine cutter blades and the head of the rod upwardly protrudes from the guillotine cutter-blade holder against the elastic biasing force of the spring; a sensor for detecting the distance from the head, the sensor being mounted to the guillotine cutter-blade holder and arranged oppositely to the head; and a thickness measuring element for measuring the thickness of the batch of paper on the basis of detection signals from the sensor.

According to a preferred embodiment of the present invention, the guide means comprises: a driving shaft mounted to the frame on at least one end of the lower guillotine cutter blade for slide movement in a vertical direction, and the driving means comprises: a motor secured to the frame; and a crank mechanism operatively connected to a rotation shaft of the motor and the driving shaft for converting the rotational movement of the motor into a vertical reciprocating movement of the driving shaft. According to another preferred embodiment of the present invention, the cutting position of the guillotine cutter-blade holder is at a position corresponding to the lower dead point of the crank mechanism and, during a cutting operation, after the pressing plate is brought into abutment with the batch of paper, the guillotine cutter-blade holder is further downwardly moved, and thereafter, when the crank mechanism reaches the lower dead point and the batch of paper is cut by the lower and upper guillotine cutter blades, the sensor detects the distance to the head of the rod, and the thickness measuring element measures the thickness of the batch of paper on the basis of the detection signal.

According to a further preferred embodiment of the present invention, in continuous operations, the thickness measuring element measures the thickness of a batch of paper and stores the measured value as a reference value during a first cutting operation, and, during a second cutting operation, the thickness measuring element measures the thickness of a next batch of paper and compares the measured value with the reference value and, when the difference between the values falls within a predetermined permissible range, the thickness measuring element determines the average of this measured value and the reference value and updates the reference value with the determined average value, while when the difference value does not fall within the permissible range, the thickness measuring element indicates the occurrence of a book binding error, and the thickness measuring element repeatedly performs this operation during the subsequently cutting operations.

According to a further preferred embodiment of the present invention, an elongated rectangular-shaped pinching plate is arranged on the upper surface of the guillotine cutter-blade holder, the pinching plate extending in parallel with the upper guillotine cutter blade at a region adjacent to the head of one rod, and the pinching plate is provided with through holes at the opposite end portions thereof, and guide rods arranged through the through holes, the guide rods protruding from the upper surface of the guillotine cutter-blade holder, the pinching plate being guided by the guide rods for vertical movement in a horizontal condition, each of the guide rods being provided with a head at its upper end, and a spring is fitted around each guide rod between the head and the pinching plate so that the pinching plate is kept pressed against the upper surface of the guillotine cutter-blade holder through the elastic force of the springs and a sample batch of paper with the same thickness as that of the batch of paper to be cut is nipped between the guillotine cutter-blade holder and the pinching plate.

According to a further preferred embodiment of the present invention, a plate-shaped sensor supporting member for supporting the sensor is arranged on the upper surface of the pinching plate, the sensor supporting member comprising a horizontal base portion which abuts the upper surface of the pinching plate, an upwardly-protruded vertical portion connected to the base portion and a horizontal sensor mounting portion which is connected to the upper end of the vertical portion and is protruded in the opposite direction from the base portion, the base portion being provided with a through hole and a supporting rod arranged through the through hole, the supporting rod protruding from the upper surface of the pinching plate, the supporting rod being provided with a head at its upper end, and a spring is fitted around the supporting rod between its head and the pinching plate so that the base portion of the sensor supporting member is kept pressed against the upper surface of the pinching plate through the elastic force of the spring, and the sensor is mounted on the back surface of the sensor mounting portion.

DETAILED DESCRIPTION OF THE PREFERRED EMBODIMENT

Figure 1:
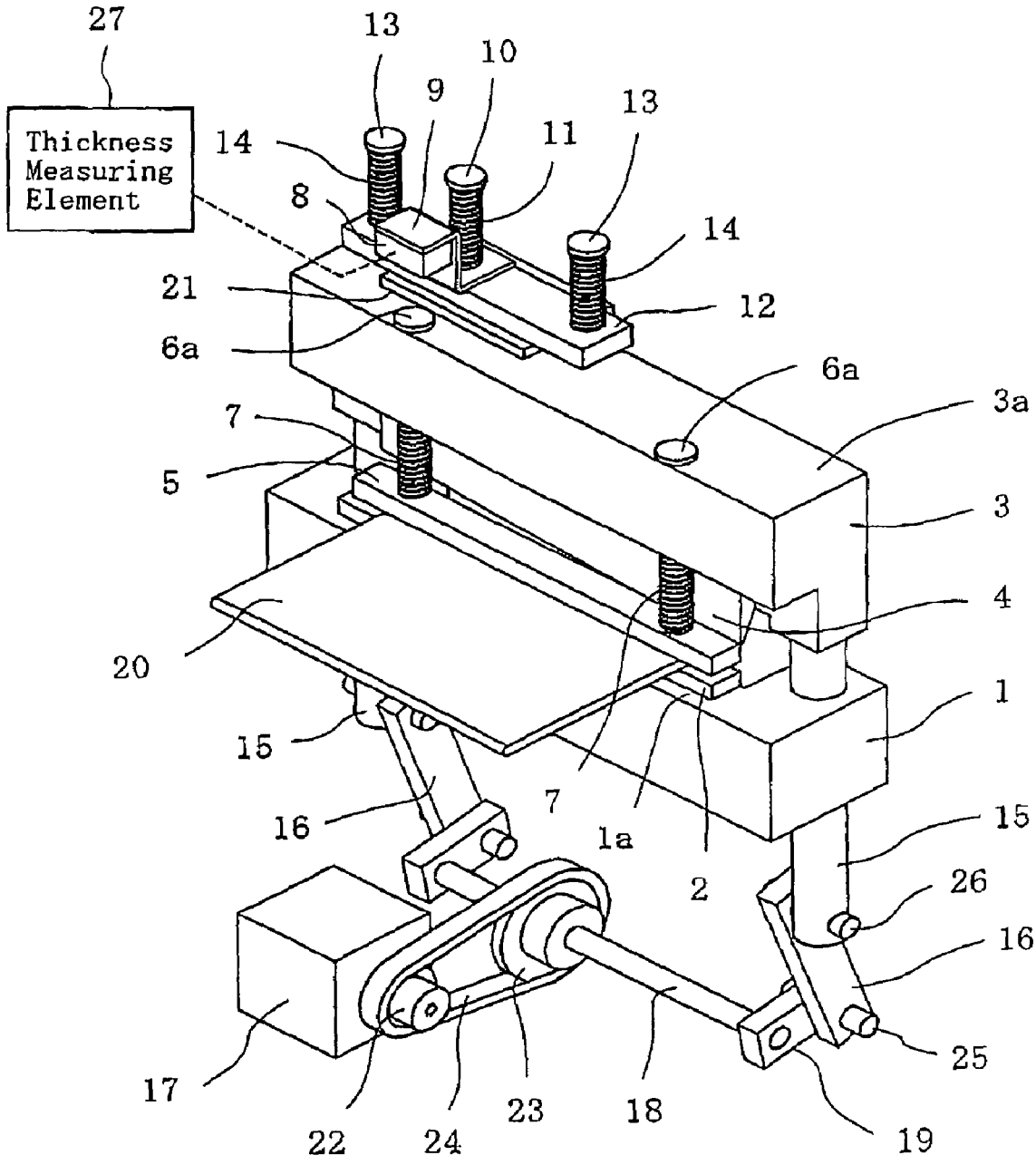
FIG. 1 is a perspective view illustrating the configuration of main part of a guillotine cutter according to a first embodiment of the present invention.
Figure 2:
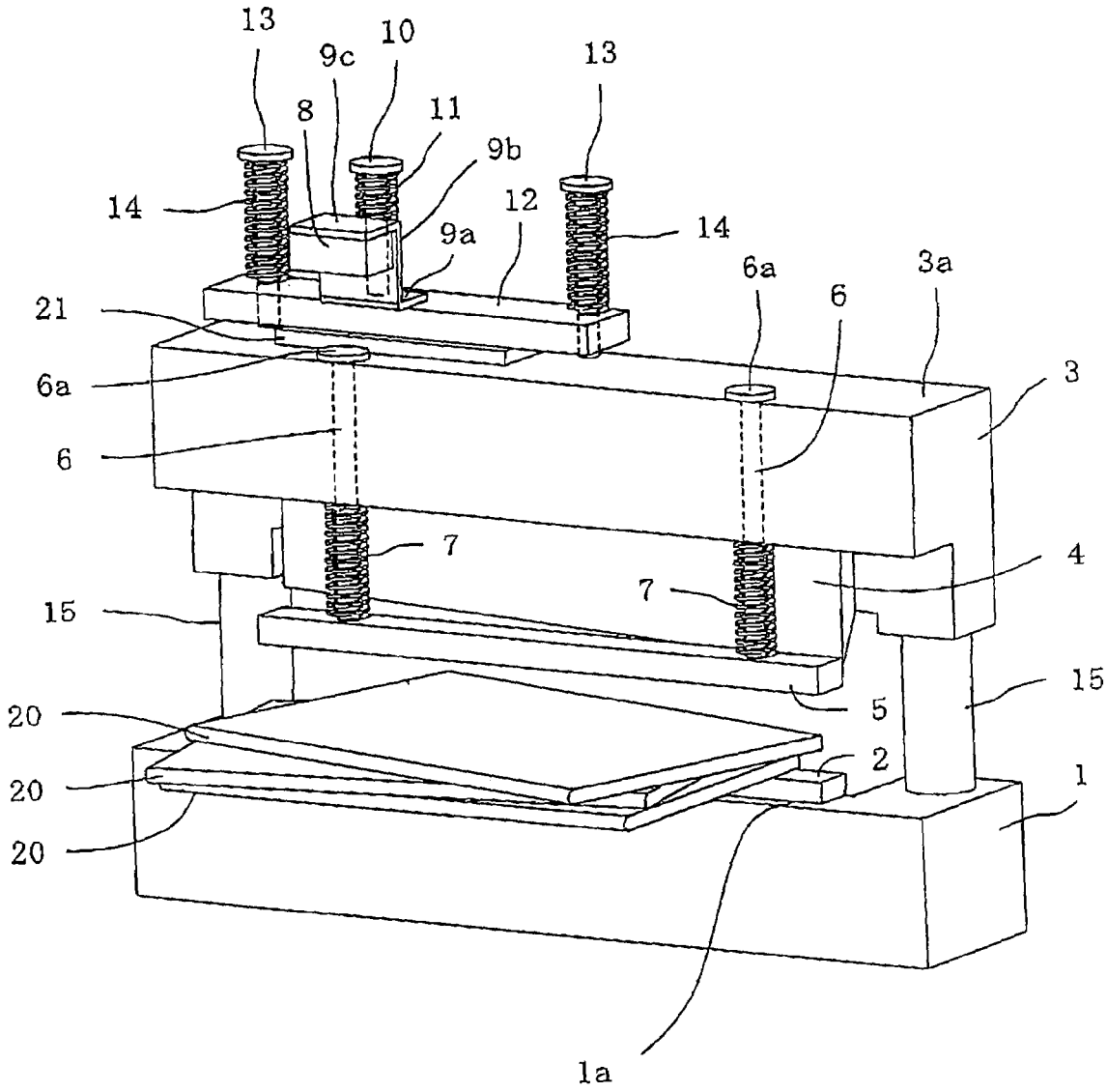
FIG. 2 is an enlarged view illustrating the configuration of a portion for detecting the thickness of a batch of paper in the guillotine cutter illustrated in FIG. 1.

Hereinafter, a preferred embodiment of the present invention will be described with reference to the attached drawings. FIG. 1 is a perspective view illustrating the configuration of main part of a guillotine cutter according to a first embodiment of the present invention, FIG. 2 is an enlarged view illustrating the configuration of a portion for detecting the thickness of a batch of paper in the guillotine cutter illustrated in FIG. 1. Referring to FIG. 1, the guillotine cutter according to the present invention includes a frame 1 including an elongated rectangular-shaped flat supporting surface 1*a* of the frame 1. lower guillotine cutter blade 2 mounted on the supporting surface la of the frame 1. The lower guillotine cutter blade 2 is constituted by a blade portion extending along one side edge of the supporting surface 1*a* and a flat plate portion continuous with the blade portion for placing a portion of a batch of paper 20 thereon.

The guillotine cutter further includes a guillotine cutter-blade holder 3 and an upper guillotine cutter blade 4 mounted to the guillotine cutter-blade holder 3 oppositely to the lower guillotine cutter blade 2. The guillotine cutter-blade holder 3 includes a flat upper surface 3*a*.

Driving shafts 15 are mounted to the frame 1 on both sides of the lower guillotine cutter blade 2 in a lengthwise direction, and are slidably guided through the frame 1 in a vertical direction. The guillotine cutter-blade holder 3 is secured to the upper ends of the respective driving shafts 15. The guillotine cutter-blade holder 3 is movably guided by the driving shafts 15 in the vertical direction at least between a cutting position at which the upper guillotine cutter blade 4 engages with the lower guillotine cutter blade 2 and a standby position at which life upper guillotine cutter blade 4 is upwardly spaced apart from the lower guillotine cutter blade 2.

Further, a motor 17 is secured to the lower portion of the frame 1 and a rotation shaft of the motor 17 is in parallel to the guillotine cutter-blade holder 3 (the upper guillotine cutter blade 4). Further, the rotation shaft of the motor 17 and the lower ends of the respective driving shafts 15 are operatively coupled to each other through a crank mechanism. As illustrated in FIG. 1, the crank mechanism includes a rotation shaft 18 which is extended in parallel with the guillotine cutter-blade holder 3(the upper guillotine cutter blade 4) and is mounted rotatably about its axis with respect to the frame 1, a first pulley 23 secured to a middle portion of the rotation shaft 18, crank arms 19 secured to the opposite ends of the rotation shaft 18, and links 16 each of which is pivotally coupled at its one end to the tip end of the corresponding crank arm 19 through a pin 25 and is pivotally coupled at the other end to the lower end of the corresponding rotation shaft 16 through a pin 26. Further, an endless belt 24 is stringed between a second pulley 22 secured to the rotation shaft of the motor 17 and the first pulley 23. Thus, the rotational movement of the motor 17 is transferred to the crank mechanism through the endless belt 24 and then converted into a reciprocating linear (vertical) movement of the driving shafts 15. In this case, when the crank mechanism reaches its upper and lower dead points, the guillotine cutter-blade holder 3 correspondingly reaches the standby position and the cutting position, respectively.

Two rods 6 are vertically slidably mounted to the guillotine cutter-blade holder 3 at positions corresponding to the plate portion of the lower guillotine cutter blade 2, such that the rods are spaced apart from each other. A pressing plate 5 is secured to the lower ends of the two rods 6 which are downwardly protruded from the guillotine cutter-blade holder 3, and the pressing plate 5 is placed oppositely to the plate portion of the lower guillotine cutter blade 2. Further, each of the rods 6 is provided with a flat head 6*a* at its upper end protruded upwardly from the guillotine cutter-blade holder 3.

Springs 7 are fitted around the respective rods 6 at the portion between the guillotine cutter-blade holder 3 and the pressing plate 5. The springs 7 act to elastically downwardly bias the rods 6 to keep the heads 6*a* abutting the upper surface 3*a* of the guillotine cutter-blade holder 3.

Thus, when the guillotine cutter-blade holder 3 is downwardly moved from the standby position toward the cutting position, the pressing plate 5 is brought into abutment with the batch of paper 20 placed on the plate portion of the lower guillotine cutter blade 2 and, thereafter, the guillotine cutter-blade holder 3 is further downwardly moved, thereby causing the lower and upper guillotine cutter blades 2 and 4 to cut the batch of paper 20 and also causing the heads 6*a* of the rods 6 to upwardly protrude from the upper surface 3*a* of the guillotine cutter-blade holder 3 against the elastic force of the springs 7.

On the upper surface 3*a* of the guillotine cutter-blade holder 3, there is placed an elongated rectangular-shaped pinching plate 12 extending in parallel with the upper guillotine cutter blade 4 at a region adjacent to the head 6*a* of one rod 6. The pinching plate 12 is provided with through holes at the opposite end portions thereof, and guide rods 13 protruded from the upper surface 3*a* of the guillotine cutter-blade holder 3 are penetrated through the respective through holes. Further, the pinching plate 12 is guided by the guide rods 13 so that it is vertically movable while being kept at I horizontal state. Each of the guide rods 13 is provided with a disk-shaped head at its upper end, and a spring 14 is fitted around each of the guide rods 13 between the head thereof and the pinching plate 12. Therefore, the pinching plate 12 is kept pressed against the upper surface 3*a* of the guillotine cutter-blade holder 3 through the elastic force of the springs 14.

On the upper surface of the pinching plate 12, there is protruded a plate-shaped sensor supporting member 9 which supports a sensor 8 for detecting the distance from the heads 6*a* of the rods 6. The sensor supporting member 9 is constituted by a horizontal base portion 9*a* which abuts the upper surface of the pinching plate 12, an upwardly-protruded vertical portion 9*b* which is connected to the base portion 9*a* aid a horizontal sensor mounting portion 9*c* which is connected to the upper end of the vertical portion 9*b* and is protruded in the opposite direction from the base portion 9*a*. The base portion 9*a* is provided with a through hole and a supporting rod 10 protruded from the upper surface of the pinching plate 12 is penetrated through the through hole, Further, the supporting rod 10 is provided with a disk-shaped head at its upper end and a spring 11 is fitted around the supporting rod 10 between the head thereof and the pinching plate 12. The base portion 9*a* of the sensor supporting member 9 is kept pressed against the upper surface of the pinching plate 12 through the elastic force of the spring 11. The sensor 8 is mounted on the back surface of the sensor mounting portion 9*c*.

In a cutting operation, a sample batch of paper 21 with the same thickness as that of the batch of paper 20 to be cut is nipped between the guillotine cutter-blade holder 3 and the pinching plate 12. Thus, the sensor 8 can be placed at the height corresponding to the thickness of the batch of paper 20 to be cut. Further, in the case where plural batches of paper 20 are concurrently cut even though only a single batch of paper 21 is sandwiched between the guillotine cutter-blade holder 3 and the pinching plate 12 as illustrated in FIG. 2, the head 6*a* of the rod 6 is butted against the sensor 8. In this case, however, the sensor supporting member 9 is upwardly moved against the elastic force of the spring 11 to alleviate the impulse force, thereby preventing fractures of the sensor 8.

The guillotine cutter further includes a thickness measuring element 27 for determining the thickness of a batch of paper 20 on the basis of detection signals from the sensor 8.

Figure 3:
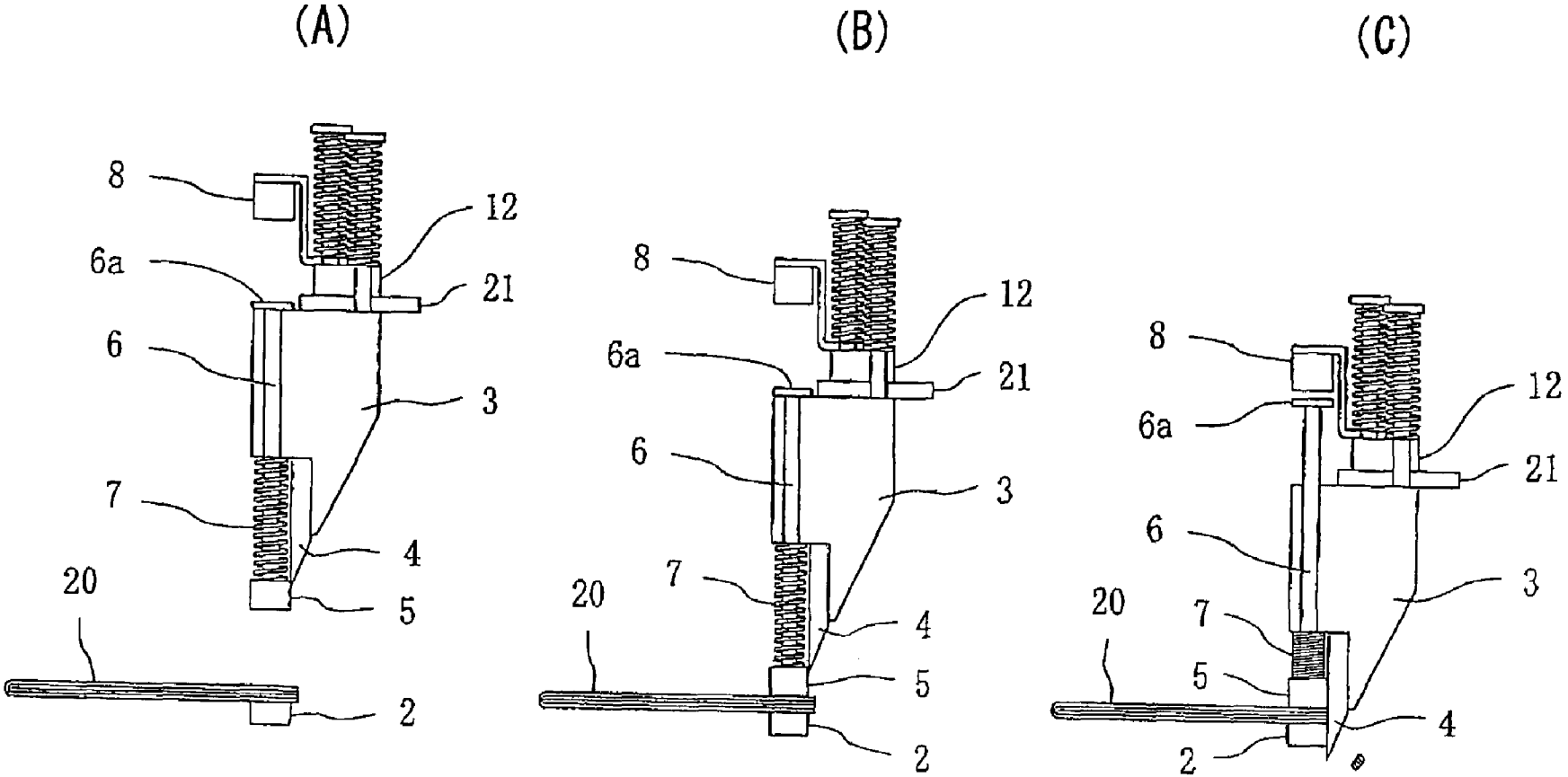
FIG. 3 is a view for explaining an operation for measuring the thickness of a batch of paper with the guillotine cutter illustrated in FIG. 1.

Next, with reference to FIG. 3, there will be described an operation for detecting the thickness of a batch of paper with the guillotine cutter according to the present invention. The guillotine cutter-blade holder 3 starts downwardly moving from the standby position (the upper dead point of the crank mechanism, in the present embodiment) (see FIG. 3(*a*)). Along with the downward movement of the guillotine cutter-blade holder 3, the upper guillotine cutter blade 4 and the pressing plate 5 are downwardly moved together and the pressing plate 5 is brought into abutment with the batch of paper 20 placed on the plate portion of the lower guillotine cutter blade 2 (see FIG. 3(*b*)). The guillotine cutter-blade holder 3 is further downwardly moved, thus causing the heads 6*a* of the rods 6 to upwardly protrude from the upper surface 3*a* of the guillotine cutter-blade holder 3 against the elastic biasing force of the spring 11. Then, when the crank mechanism reaches its lower dead point, correspondingly, the guillotine cutter-blade holder 3 reaches the lowermost position so that the batch of paper 20 is cut by the lower and upper guillotine cutter blades 2 and 4. At this time, the heads 6*a* of the rods 6 are protruded from the upper surface 3*a* of the guillotine cutter-blade holder 3 by the maximum length (see FIG. 3(*c*)). On the other hand, at this time, the distance between the sensor 8 and the heads 6*a* becomes the smallest one and the sensor 8 detects this distance. On the basis of the detection signal, the thickness measuring element 27 determines the thickness of the batch of paper 20.

Figure 4:
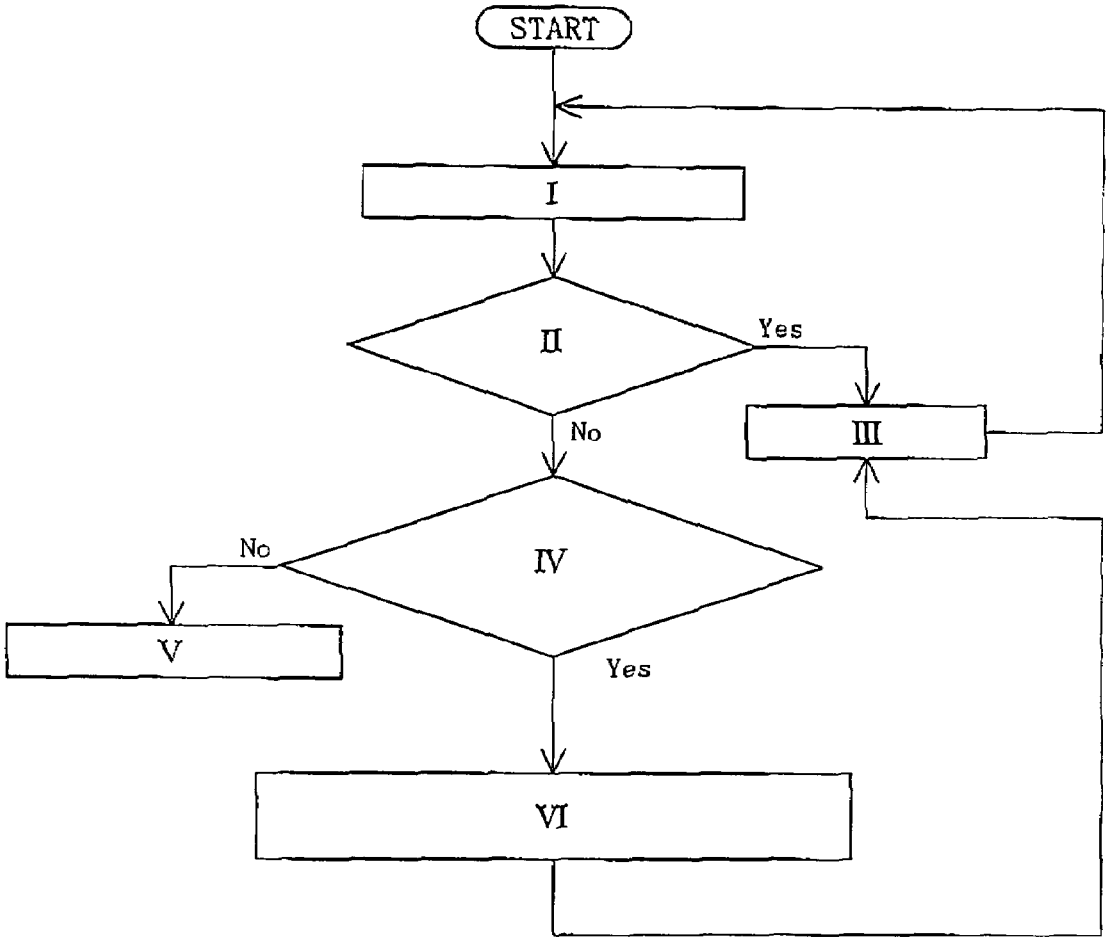
FIG. 4 is a flow diagram explaining an operation for measuring the thickness of a batch of paper in the case where the guillotine cutter illustrated in FIG. 1 is continuously operated.

When the guillotine cutter is continuously operated, as illustrated in FIG. 4, the thickness measuring element 27 determines the thickness of a batch of paper and stores the measured value as a reference value, during a first cutting operation. Then, during the second cutting operation, the thickness measuring element 27 determines the thickness of a next batch of paper, compares the measured value with the reference value and determines whether or not the difference between these values falls within a predetermined permissible range. When the difference value falls within the permissible range, the thickness measuring element 27 determines the average of this measured value and the reference value and updates the reference value with the determined average value. If the difference value does not fall within the permissible range, the thickness measuring element 27 indicates the occurrence of a book binding error (pages missing or pages redundancy). The thickness measuring element 27 repeatedly performs the aforementioned operation in the third and more cutting operations. In the present embodiment, the permissible error value is determined in advance, the average of a measured value and a reference value is determined and the reference value is updated with the average value during every cutting operation. However, it is also possible to determine, in advance, an absolute reference value and a permissible error value and simply make a comparison between a measured value and the reference value to determine whether or not there is a book binding error, during every cutting operation.

As described above, with the present invention, it is possible to provide a guillotine cutter having a device for accurately and certainly detecting the thickness of a batch of paper, with a significantly simple and inexpensive configuration.

The invention claimed is:

1. A guillotine cutter comprising:

a frame (1) having an elongated rectangular-shaped flat supporting surface (1*a*);

a lower guillotine cutter blade (2) mounted on said supporting surface (1*a*) of said frame (1), said lower guillotine cutter blade (2) comprising a blade portion extending along one side of said supporting surface (1*a*) and an elongated flat plate portion connecting with said blade portion, a portion of a batch of paper (20) being placed on said plate portion;

a guillotine cutter-blade holder (3);

an upper guillotine cutter blade (4) mounted to said guillotine cutter-blade holder (3) and arranged oppositely to said lower guillotine cutter blade (2);

guide means (15) mounted to said frame (1) for vertically guiding said guillotine cutter-blade holder (3) in such a manner that said guillotine cutter-blade holder (3) is movable at least between a cutting position at which said upper guillotine cutter blade (4) engages with said lower guillotine cutter blade (2) and a standby position at which said upper guillotine cutter blade (4) is upwardly spaced apart from said lower guillotine cutter blade (2);

driving means (16 to 19, 22 to 26) for reciprocally moving said guillotine cutter-blade holder (3) in the vertical direction;

at least one rod (6) mounted to said guillotine cutter-blade holder (3) at a position corresponding to said plate portion of said lower guillotine cutter blade (2) for vertical slide movement;

a pressing plate (5) arranged oppositely to said plate portion of said lower guillotine cutter blade (2) and secured to the lower end of said rod (6) which is downwardly protruded from said guillotine cutter-blade holder (3);

a flat head (6*a*) provided at the upper end of said rod (6) which is upwardly protruded from said guillotine cutter-blade holder (3); and a spring (7) fitted around said rod (6) between said guillotine cutter-blade holder (3) and said pressing plate (5) for downwardly elastically biasing said rod (6) to keep said head (6*a*) abutted against said guillotine cutter-blade holder (3), during downward movement of said guillotine cutter-blade holder (3) from said standby position toward said cutting position, said pressing plate (5) being brought into abutment with the batch of paper (20) placed on the plate portion of said lower guillotine cutter blade (2), thereafter, said guillotine cutter-blade holder (3) being further downwardly moved, so that said batch of paper (20) is cut by said lower and upper guillotine cutter blades (2 and 4) and the head (6*a*) of said rod (6) upwardly protrudes from said guillotine cutter-blade holder (3) against the elastic biasing force of said spring (7);

a sensor (8) for detecting the distance from said head (6*a*), said sensor (8) being mounted to said guillotine cutter-blade holder (3) and arranged oppositely to said head (6*a*); and a thickness measuring element (27) for measuring the thickness of said batch of paper (20) on the basis of detection signals from said sensor (8).

2. The guillotine cutter according to claim 1, wherein said guide means comprises:

a driving shaft (15) mounted to said frame (1) on at least one end of said lower guillotine cutter blade (2) for slide movement in a vertical direction, and said driving means comprises:

a motor (17) secured to said frame (1); and a crank mechanism (16, 18 to 19, 22 to 26) operatively connected to a rotation shaft of said motor (17) and said driving shaft (15) for converting the rotational movement of said motor (17) into a vertical reciprocating movement of said driving shaft (15).

3. The guillotine cutter according to claim 2, wherein said cutting position of said guillotine cutter-blade holder (3) is at a position corresponding to the lower dead point of said crank mechanism (16, 18 to 19, 22 to 26) and, during a cutting operation, after said pressing plate (5) is brought into abutment with said batch of paper (20), said guillotine cutter-blade holder (3) is further downwardly moved, and thereafter, when said crank mechanism (16, 18 to 19, 22 to 26) reaches the lower dead point and said batch of paper (20) is cut by said lower and upper guillotine cutter blades (2 and 4), said sensor (8) detects the distance to the head (6*a*) of said rod (6), and said thickness measuring element (27) measures the thickness of said batch of paper (20) on the basis of the detection signal.

4. The guillotine cutter according to claim 3, wherein in continuous operations, said thickness measuring element (27) measures the thickness of a batch of paper and stores the measured value as a reference value during a first cutting operation, and, during a second cutting operation, the thickness measuring element (27) measures the thickness of a next batch of paper (20) and compares the measured value with said reference value and, when the difference between the values falls within a predetermined permissible range, the thickness measuring element (27) determines the average of this measured value and said reference value and updates the reference value with the determined average value, while when said difference value does not fall within said permissible range, said thickness measuring element (27) indicates the occurrence of a book binding error, and the thickness measuring element (27) repeatedly performs this operation during the subsequently cutting operations.

5. The guillotine cutter according to claim 1, wherein an elongated rectangular-shaped pinching plate (12) is arranged on the upper surface (3*a*) of the guillotine cutter-blade holder (3), said pinching plate (12) extending in parallel with said upper guillotine cutter blade (4) at a region adjacent to the head (6*a*) of one rod (6), and said pinching plate (12) is provided with through holes at the opposite end portions thereof, and guide rods (13) arranged through said through holes, said guide rods (13) protruding from the upper surface (3*a*) of said guillotine cutter-blade holder (3), said pinching plate (12) being guided by the guide rods (13) for vertical movement in a horizontal condition, each of said guide rods (13) being provided with a head at its upper end, and a spring (14) is fitted around each guide rod (13) between the head and said pinching plate (12) so that said pinching plate (12) is kept pressed against the upper surface (3*a*) of said guillotine cutter-blade holder (3) through the elastic force of said springs (14) and a sample batch of paper (21) with the same thickness as that of the batch of paper (20) to be cut is nipped between said guillotine cutter-blade holder (3) and said pinching plate (12).

6. The guillotine cutter according to claim 5, wherein a plate-shaped sensor supporting member (9) for supporting said sensor (12) is arranged on the upper surface of said pinching plate (12), said sensor supporting member (9) comprising a horizontal base portion (9*a*) which abuts the upper surface of the pinching plate (12), an upwardly-protruded vertical portion (9*b*) connected to said base portion (9*a*) and a horizontal sensor mounting portion (9*c*) which is connected to the upper end of said vertical portion (9*b*) and is protruded in the opposite direction from the base portion (9*a*), said base portion (9*a*) being provided with a through hole and a supporting rod (10) arranged through said through hole, said supporting rod (10) protruding from the upper surface of the pinching plate (12), said supporting rod (10) being provided with a head at its upper end, and a spring (11) is fitted around said supporting rod (10) between its head and said pinching plate (12) so that the base portion (9*a*) of said sensor supporting member (9) is kept pressed against the upper surface of said pinching plate (12) through the elastic force of said spring (11), and said sensor (8) is mounted on the back surface of said sensor mounting portion (9*c*).

* * * * *